US007239244B2

(12) United States Patent
Leyden et al.

(10) Patent No.: US 7,239,244 B2
(45) Date of Patent: Jul. 3, 2007

(54) SYSTEM AND METHOD FOR MONITORING A PORTABLE ARTICLE

(75) Inventors: Roger J. Leyden, Inverness, IL (US); Michael Parent, Palatine, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 173 days.

(21) Appl. No.: 11/112,384

(22) Filed: Apr. 22, 2005

(65) Prior Publication Data

US 2006/0238343 A1 Oct. 26, 2006

(51) Int. Cl.
*G06B 13/14* (2006.01)

(52) U.S. Cl. ..... 340/572.9; 340/572.1; 340/572.8; 340/568.2

(58) Field of Classification Search ..... 340/568.2, 340/568.3, 572.1, 572.8, 572.9
See application file for complete search history.

(56) References Cited

U.S. PATENT DOCUMENTS 5,561,417 A * 10/1996 Rothbaum et al. ..... 340/568.2
5,610,587 A * 3/1997 Fujiuchi et al. ..... 340/568.2
5,650,768 A * 7/1997 Eswaran ..... 340/572.1
5,831,531 A * 11/1998 Tuttle ..... 340/568.2
5,856,782 A * 1/1999 Sasagawa et al. ..... 340/572.9
5,864,290 A * 1/1999 Toyomi et al. ..... 340/572.9
5,959,532 A * 9/1999 Fujiuchi et al. ..... 340/572.3
6,243,005 B1 * 6/2001 Haimovich et al. ..... 340/427
6,271,801 B2 * 8/2001 Tuttle et al. ..... 343/872
6,727,817 B2 * 4/2004 Maloney ..... 340/572.8
6,731,212 B2 * 5/2004 Hirose et al. ..... 340/572.9
7,129,841 B2 * 10/2006 Feibelman ..... 340/568.1
2003/0174059 A1 * 9/2003 Reeves ..... 340/573.4
2005/0231365 A1 * 10/2005 Tester et al. ..... 340/568.1
2006/0170550 A1 * 8/2006 Marsilio et al. ..... 340/568.2

* cited by examiner

*Primary Examiner*—Jeffery Hofsass
*Assistant Examiner*—Anne V. Lai
(74) *Attorney, Agent, or Firm*—Wood, Phillips, Katz, Clark & Mortimer

(57) ABSTRACT

A system for monitoring a portable article. The system has a housing, a detectable signal generator on the housing, a detection circuit on the housing, and a jumper element having first and second ends. The jumper element has a) an operative state wherein the first and second jumper element ends are electrically connected to the detection circuit at first and second locations and the jumper element defines a conductive path electrically connecting between the first and second locations on the detection circuit and b) a disabled state. In the disabled state, one of i) the first end of the jumper element is disconnected from the detection circuit at the first location ii) the second end of the jumper element is disconnected from the detection circuit at the second location and iii) the jumper element is severed between the first and second ends, so that the conductive path between the first and second locations is interrupted. The first and second ends of the jumper element are releasably connectable to the detection circuit to allow the jumper element to be selectively removed and either reinstalled or replaced by another jumper element.

37 Claims, 8 Drawing Sheets

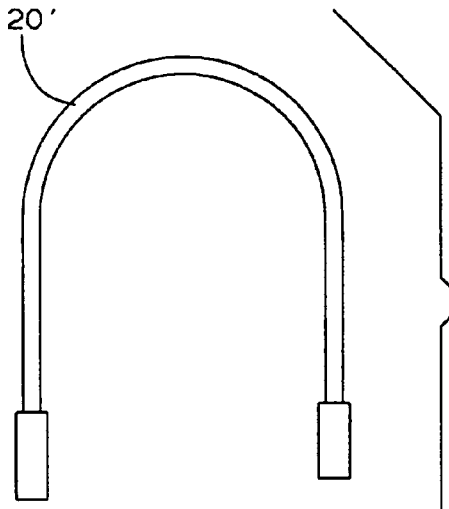
FIG. 13
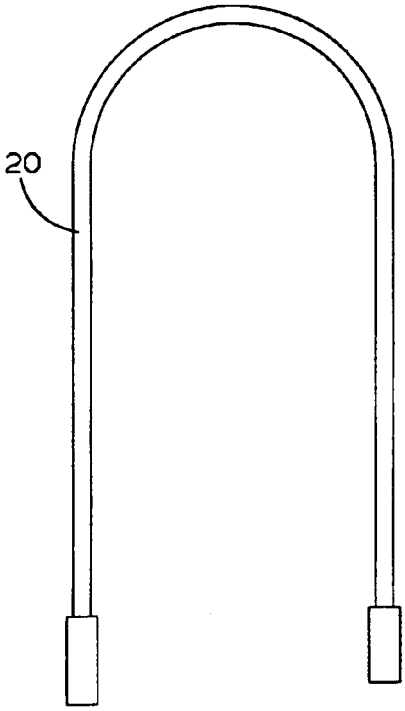
FIG. 14
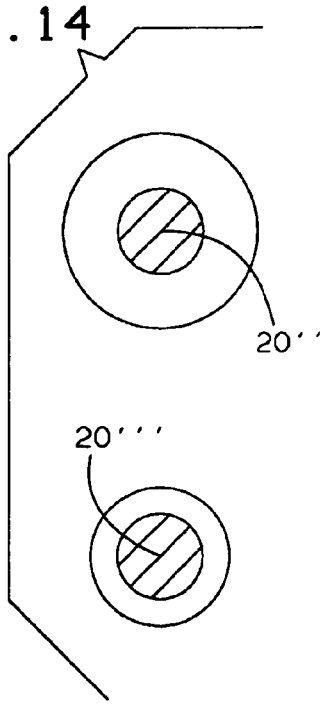

SYSTEM AND METHOD FOR MONITORING A PORTABLE ARTICLE

BACKGROUND OF THE INVENTION

1. Field of the Invention

This invention relates to a system and method for monitoring portable articles so as to avoid unauthorized removal thereof from a prescribed area.

2. Background Art

Theft of portable articles from point of purchase displays has reached epidemic levels worldwide. Extreme competition for sales has caused purveyors to display articles with such accessibility that they are highly vulnerable to being removed by unauthorized personnel. Point of purchase displays are tending more and more towards allowing unencumbered inspection and operation of portable devices, such as electronic devices, to allow customers to make informed purchasing decisions. Inherently, by making the articles so convenient for inspection, they likewise become prone to being absconded with by persons that are not easily distinguishable from legitimate purchasers.

The security industry has developed myriad systems for securing and monitoring portable articles, as at point of purchase displays. These systems range from simple mechanical tethers to sophisticated, programmable electronics, with high level monitoring capabilities. Some of these systems rely on mechanical and/or electromechanical cables to confine articles within a prescribed area, as dictated by the lengths of the cables. Another type of system uses a tag that is secured to an article and that is detected by scanners, which are strategically placed near exit doors. These systems are generally designed so that at the checkout counter the tag is either disarmed or removed from the article so that the scanner at the exit will not cause a detectable signal to be generated, as the article is removed from the premises. These systems offer the advantage that the articles are essentially unencumbered so that they can be inspected and used in normal fashion, yet will be protected against unauthorized removal from a prescribed area.

One form of the last-described system that has been utilized in recent years is a reusable system that has both a tag, which will be detected by a scanner, and an audible alarm that is activated in the event that the system is removed from the article being monitored. In one exemplary form, a housing is provided with a chamber within which electronic components and a power supply are provided. A detection circuit can be armed by initially establishing a conductive path through a jumper element. The jumper element has an end that is selectively operatively attached to complete a circuit path and separable from a component on the housing. In the former state, the jumper element and housing define a closed loop that can be formed around any appropriate part of an article to be secured, such as a handle on a tool box or a piece of luggage, a finger opening on a power tool, etc. By using an authorized operating key, the end of the jumper element can be secured and the system armed so that a break in continuity of the path defined by the jumper element will cause the alarm to be activated. This construction avoids undetectable removal of the armed system from an article being monitored in the absence of the system being disarmed through the use of the key. At the same time, with the system operatively attached to an article, the tag will be detected by a scanner, should an individual attempt to remove the article without the system being appropriately disarmed or removed.

While these systems are effective in terms of their security capability, they represent a significant financial investment to those businesses that use them. One advantage afforded by this construction is that the systems are readily reusable. Checkout personnel can use the authorized operating key to disarm the system and separate the same from the article. The removed system can then be placed on another article by performing relatively simple re-assembly and re-arming steps.

One of the biggest problems with the above types of systems is that severance of the jumper element by a thief precludes re-use of the system. In a conventional construction, one end of the jumper element is permanently electrically and mechanically attached to and within the housing. Once the jumper element is severed or damaged, it is not economically practical to repair or reconstruct the system, even though the jumper element itself represents a relatively insignificant part of the overall expense of the system.

Consequently, those using these types of systems in the past have had to make decisions with respect to investment in security by comparing anticipated losses in dollars in the absence of their use, versus costs of such security systems, factoring in the need to replace the same each time a jumper element is compromised. In some situations, the shop owner may be inclined to forego using this effective type of security system only to be required to make a later future investment when theft losses accumulate. A failure to use appropriate security may make a business an inviting target for thieves.

SUMMARY OF THE INVENTION

In one form, the invention is directed to a system for monitoring a portable article. The system has a housing, a detectable signal generator on the housing, a detection circuit on the housing, and a jumper element having first and second ends. The jumper element has a) an operative state wherein the first and second jumper element ends are electrically connected to the detection circuit at first and second locations and the jumper element defines a conductive path electrically connecting between the first and second locations on the detection circuit and b) a disabled state. In the disabled state, one of i) the first end of the jumper element is disconnected from the detection circuit at the first location ii) the second end of the jumper element is disconnected from the detection circuit at the second location and iii) the jumper element is severed between the first and second ends, so that the conductive path between the first and second locations is interrupted. The first and second ends of the jumper element are releasably connectable to the detection circuit to allow the jumper element to be selectively removed and either reinstalled or replaced by another jumper element.

In one form, the system further includes an Electronic Article Surveillance ("EAS") tag on the housing that is detectable by a scanner to determine that the system has moved past the scanner.

The system may be provided in combination with a scanner for detecting the presence of the EAS tag and, as an incident thereof, causing the generation of a detectable signal.

The system may further include a locking system including cooperating locking assemblies at the first and second jumper element ends and the housing.

In one form, the locking assembly on the first jumper element end includes a first shoulder, with the locking assembly on the housing including a second shoulder. The first and shoulders confront each other to prevent the first end of the jumper element from being disconnected from the detection circuit at the first location.

In one form, the locking assembly on the housing has a locked state and a released state. With the locking assembly on the housing in the released state, the first end of the jumper element can be selectively connected to and disconnected from the detection circuit at the first location. With the first end of the jumper element connected to the detection circuit at the first location and the locking assembly on the housing in the locked state, the first and second shoulders confront each other to prevent the first end of the jumper element from being disconnected from the detection circuit at the first location.

In one form, the locking assembly on the second jumper element end includes a third shoulder and the locking assembly on the housing includes a fourth shoulder. With the locking assembly on the housing in the released state, the second end of the jumper element can be selectively connected to and disconnected from the detection circuit at the second location. With the second end of the jumper element connected to the detection circuit at the second location and the locking assembly on the housing in the locked state, the third and fourth shoulders confront each other to prevent the second end of the jumper element from being disconnected from the detection circuit at the second location.

In one form, the locking assembly on the housing includes a latch assembly that moves as one piece between a first position, wherein the locking assembly on the housing is in the locked state, and a second position, wherein the locking assembly on the housing is in the released state.

The latch assembly may be pivotable about an axis between the first and second positions therefor.

In one form, the locking assembly on the housing includes a key operated tumbler that is repositionable through a key to change the latch assembly on the housing between the first and second positions.

In one form, the latch assembly has a plate with first and second receptacles to respectively receive portions of the first and second ends of the jumper element.

In one form, the detection circuit has an armed state and an unarmed state. The system further includes a switch that is repositionable between normal and activated positions. The detection circuit is changeable from the unarmed state into the armed state as an incident of the switch being changed from the normal position into the activated position. The switch is changed from the normal position into the activated position as an incident of the latch assembly changing from the second position into the first position therefor.

In one form, the switch is biased into the normal position and is engaged by the latch assembly and moved into the activated position as the latch assembly is changed from the second position into the first position therefor.

In one form, there are cooperating connecting parts on the first end of the jumper element and the housing which releasably frictionally maintain the first end of the jumper element connected to the detection circuit at the first location.

In one form, there are cooperating connecting parts on the second end of the jumper element and the housing which releasably frictionally maintain the second end of the jumper element connected to the detection circuit at the second location.

In one form, the detectable signal generator is activated as an incident of the jumper element being changed from the operative state into the disabled state with the detection circuit in the armed state.

The system may further be provided in combination with a second jumper element that can be placed in an operative state in place of the first mentioned jumper element.

The second jumper element may have a configuration that is different than the configuration of the first mentioned jumper element. The first mentioned and second jumper elements may each have a length, with the lengths of the first mentioned and second jumper elements being different.

The jumper element may have a bendable construction.

In one form, the jumper element has a metal core and first and second end fittings crimped to the metal core and respectively defining the second and third shoulders.

The system may further include a battery power source on the housing for powering the detectable signal generator and the detection circuit.

In one form, the housing has a component that can be repositioned to selectively allow access to the battery power source, as to permit replacement thereof.

In one form, the EAS tag is permanently in a state to be detected by the scanner and cause the scanner to generate a detectable signal.

The system may be provided in combination with a portable article having a portion around which a closed loop, defined cooperatively by the jumper element and housing, extends.

The invention is also directed to a method of monitoring a portable article. The method includes the steps of: a) providing a system for monitoring a portable article including a housing, a detectable signal generator on the housing, a detection circuit on the housing having an armed state and an unarmed state, and a first jumper element having first and second ends; b) directing the first jumper element around a part of the portable article; c) electrically connecting the first end of the first jumper element to the detection circuit at a first location; d) electrically connecting the second end of the jumper element to the detection circuit at a second location so that a conductive path is defined by the first jumper element between the first and second locations; e) with the first and second ends of the first jumper element electrically connected to the detection circuit at the first and second locations, changing the detection circuit from the unarmed state into the armed state, wherein the detectable signal generator will be activated in the event that the conductive path defined by the first jumper element between the first and second locations is interrupted; f) disconnecting the first jumper element fully from the housing and detection circuit; g) either i) reconnecting the first and second ends of the first jumper element to the detection circuit at the first and second locations or ii) connecting first and second ends of a second jumper element to the detection circuit at the first and second locations to define a conductive path between the first and second locations; and h) changing the detection circuit from the unarmed state into the armed state with the first and second ends of the first or second jumper element electrically connected to the detection circuit at the first and second locations.

In one form, the step of providing a system for monitoring an article further includes the steps of providing an EAS tag on the system and a scanner for detecting the presence of the EAS tag and, as an incident thereof, causing the generation of a detectable signal.

The second jumper element may have a different configuration than the first jumper element.

In one form, the first and second jumper elements each have a length and the lengths of the first and second jumper elements are different.

The method may further include the step of locking the first and second ends of the first jumper element so that the first and second ends of the first jumper element cannot be disconnected from the detection circuit at the first and second locations.

In one form, the step of locking the first and second ends of the first jumper element involves repositioning a latch assembly relative to the housing to thereby simultaneously lock the first and second ends of the first jumper element.

The detection circuit may be changed from the armed state into the unarmed state as an incident of repositioning the latch assembly in a manner so as to lock the first and second ends of the jumper element.

In one form, the step of electrically connecting the first end of the first jumper element to the detection circuit may involve joining cooperating connecting parts on the first end of the first jumper element and the housing to releasably frictionally maintain the first end of the jumper element connected to the detection circuit at the first location.

The step of electrically connecting the second end of the first jumper element to the detection circuit may involve joining cooperating connecting parts on the second end of the first jumper element and the housing to releasably frictionally maintain the second end of the jumper element connected to the detection circuit at the second location.

BRIEF DESCRIPTION OF THE DRAWINGS

FIG. 13 is an elevation view of a kit, including jumper elements having different lengths;

FIG. 14 is a cross-sectional view of different jumper elements that can be sold as a kit and having different diameters;

DETAILED DESCRIPTION OF THE DRAWINGS

Figure 1:
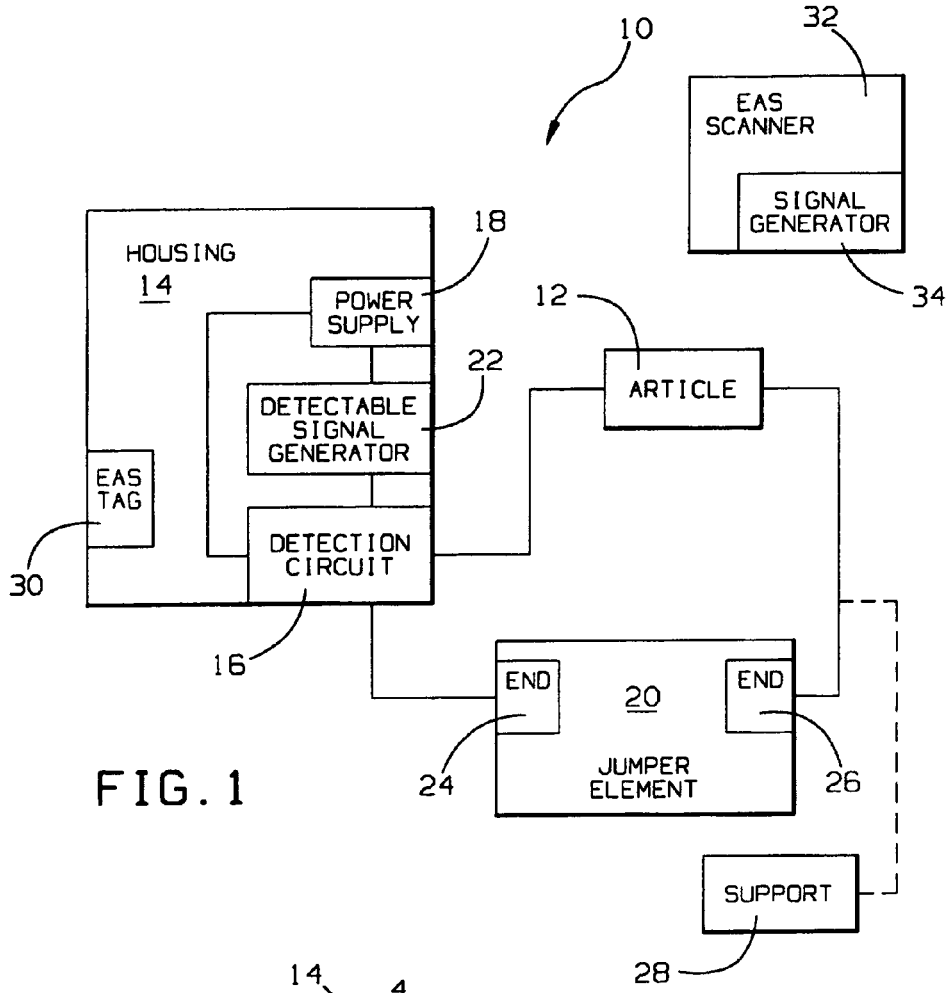
FIG. 1 is a schematic representation of a system for monitoring a portable article, according to the present invention, and including a housing with components therein that are electrically interactive through a separable jumper element.

In FIG. 1, a schematic representation of a system for monitoring a portable article, according to the present invention, is shown at 10. The article 12 may be, for example, any portable article that is susceptible to being removed from a prescribed area by an unauthorized individual. The nature of the article 12 is not otherwise limited.

The system 10 consists of a housing 14 which provides a support for the system components, namely a detection circuit 16 which is powered by a supply 18. The detection circuit 16 is designed to sense the change of a jumper element 20 from an operative state therefor into a disabled state and to thereby cause the activation of a detectable signal generator 22, whereby a system supervisor will be alerted to a security breach.

More specifically, the jumper element 20 has a first end 24 and a second end 26, which are respectively electrically connected to first and second locations on the detection circuit 16 to establish a conductive path between the first and second locations with the jumper element 20 in its operative state. The jumper element 20 and housing 14 cooperatively define a closed loop which mechanically interacts with the article 12 by either extending around a circumference thereof or around a part thereof that defines an enclosed opening. By reason of this arrangement, the jumper element 20 must be disabled to allow release of the system 10 from the article 12 by either disconnecting one or both of the ends 24, 26, or severing the jumper element 20. Consequently, any attempt by a would-be thief to separate the system 10 from the article 12, by changing the state of the jumper element 20, is detected by the circuit 16 and, as an incident of that detection, a detectable signal is generated to alert either an on-site or remote system supervisor.

The system 10 is shown in schematic form in that a multitude of different configurations and combinations of components are contemplated, using the basic inventive concepts described herein. The exemplary system 10 described below is but representative in nature and is not otherwise intended to be limiting.

Different security applications for the system 10 are contemplated. The jumper element 20, which is engaged with the article 12, may be secured to a support 28. Through this arrangement, the article 12 will be confined within a particular range as dictated by the configuration of the jumper element 20 that, in combination with the housing 14, encircles the article 12, or a part thereof. To release the article 12, the would-be thief would have to disable the jumper element 20 by disconnecting the jumper element ends 24, 26, or by severing the jumper element 20. In either event the breach would be detected by the system 10.

Alternatively, and more preferably, the jumper element 20 is connected to the article 12 and is portable in conjunction therewith. To prevent unauthorized removal of the article 12, the housing includes an EAS tag 30 which can be detected by a scanner 32 that may be strategically located, as near an exit door in a commercial establishment which the article 12 is stored and/or sold. Upon sensing the presence of the EAS tag 30, the scanner 32 causes a signal generator 34 to be activated. A detectable signal is generated that will be recognized either on site or remotely to allow the individual carrying the article 12 to be confronted before his/her departure from a location that is being monitored.

Details of one exemplary form of the system 10 are shown in FIGS. 2 through 12. The housing 14 is shown constructed with two cup-shaped housing halves 36 38. Stepped, free edges 40, 42 of the housing halves 36, 38 are matched in shape and configuration and can be suitably joined, as by use of an adhesive, spin welding, etc., to produce a substantially closed, cylindrical chamber 44 within which certain of the system components reside. In this embodiment, the primary components consist of the detection circuit 16, the detectable signal generator 22, the power supply 18, and the EAS tag 30. The closed, cylindrical configuration for the housing 14 is exemplary, as virtually a limitless number of different shapes could be used as an alternative to that shown. The two-part housing construction is likewise optional and facilitates assembly of the components within the chamber 44. That is, the components can be assembled in each housing half 36, 38, after which the housing halves 36, 38 can be united to complete assembly of the housing 14 and operative positioning of the components in the chamber 44. In this particular construction, a baffle 46 provides a component support and becomes an integral part of the housing 14, as does a printed circuit board 48 upon which the detection circuit 16 is formed. These components will be considered as part of the "housing" in the description and claims herein.

The description herein will not go into the details of the detection circuit 16. Myriad different forms of detection circuit are known in this industry and can be used interchangeably. It suffices to say that the detection circuit 16 has an armed state and an unarmed state. As explained in greater detail below, through a switch 50, the detection circuit 16 is changed between the armed and unarmed states. The detection circuit 16 can be placed in the armed state only with the jumper element in its operative state with the ends 24, 26 electrically connected to the printed circuit board 48 at first and second spaced locations 52, 54 thereon so as to define a conductive path through the jumper element 20 between the locations 52, 54.

The jumper element 28 consists of a flexible cord/body 56 that, in this embodiment, has a conductive core 58 and a non-conductive outer layer or coating 60. The first jumper element end 24 is defined by an end fitting 62, with the second jumper element end 26 defined by a like end fitting 64. The end fittings 62, 64 are electrically connected to the core 58, as hereinafter described. The exemplary end fitting 62 consists of a conductive main body 66 with a connecting part 68 through which the second jumper element end 26 is electrically connected to the circuit board 48 at the first location 52. The body 66 has a reduced diameter midportion 70 which defines a first shoulder 72 facing in an axial direction.

A receiver 74 projects from the body 66 at the axial end thereof remote from the connecting part 68. The receiver 74 has a blind bore 76 to accommodate the core 58 of the flexible cord/body 56 and is crimped thereto to both mechanically connect the flexible core/body 56 to the end fitting 62 and establish a continuous conductive path through the core 58 to and through the body 66 to the connecting part 68.

The end fitting 64 generally has the same construction as the end fitting 62 with a corresponding, conductive main body 66' which has a connecting part 68', a reduced diameter midportion 70', and an axially facing shoulder 72'. A receiver 74' accommodates the end of the flexible cord/body 56, opposite the end which cooperates with the end fitting 62.

The receivers 74, 74' are preferably crimped so as to permanently join the flexible cord/body 56 with the end fittings 62, 64. This crimping also assures that a continuous conductive path is maintained through the cord/body 56 fully between the connecting parts 68, 68' on the end fittings 62, 64, respectively.

Figure 10:
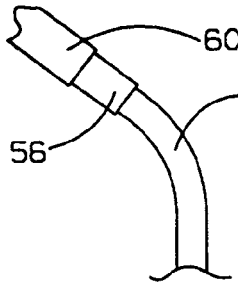
FIG. 10 is an enlarged, fragmentary, elevation view of cooperating connecting parts on the housing and one jumper element through which electrical and frictional mechanical connection is established.
Figure 11:
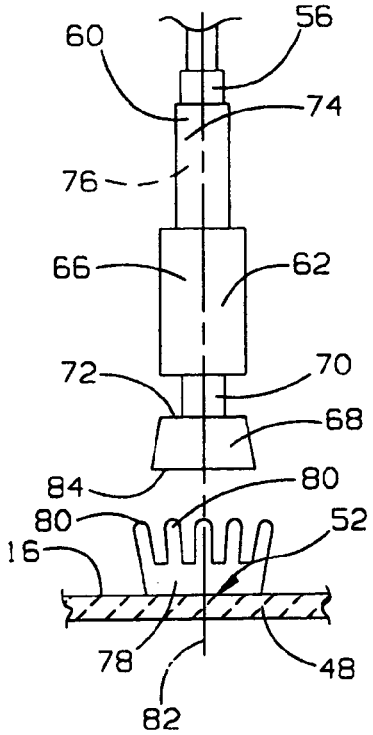
FIG. 11 is an enlarged, fragmentary, elevation view of a switch used to arm a detection circuit on the housing as an incident of the locking system being changed from the release state into the locked state therefor.
Figure 11:
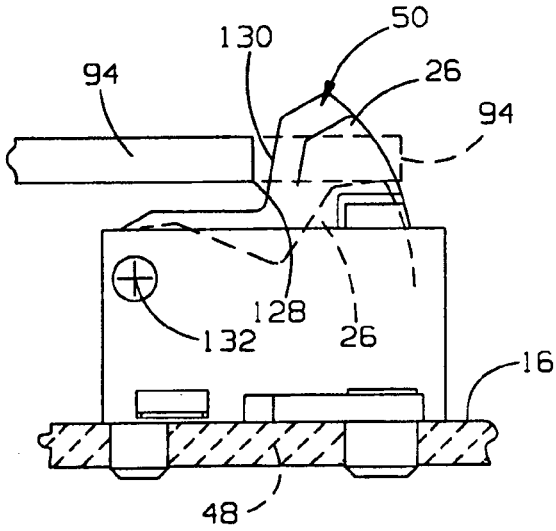
Figure 12:
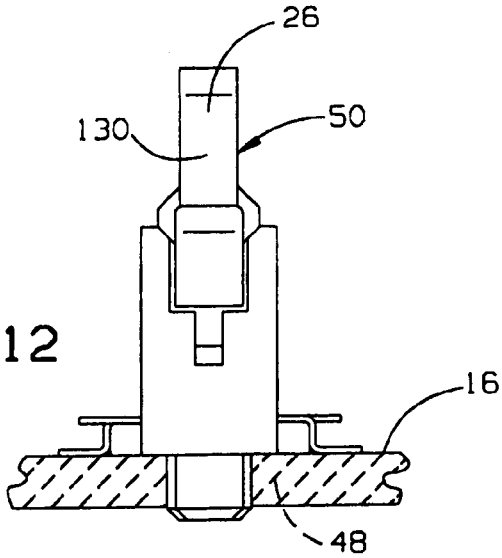
FIG. 12 is a view as in FIG. 11, but rotated through 90° around a vertical axis.

The connecting part 68 on the end fitting 62 is electrically and mechanically connected to the circuit board 48 at the first location 52 through a cooperating connecting part 78. The connecting part 68' on the end fitting 64 is connected through a like connecting part 78' on the circuit board 48. As seen in FIG. 10, the exemplary connecting part 78 is constructed in a generally "crown" shape with a series of spaced, deflectable fingers 80, extending around an axis 82. The connecting part 68 has a free end 84 dimensioned so that as the connecting parts 68, 78, are moved axially, one against the other, the free end 84 causes the fingers 80 to deflect radially outwardly until the connecting part 68 fully seats in the connecting part 78, whereupon the fingers 80 spring back inwardly towards an undeformed state to cooperatively capture the connecting part 68. The connecting parts 68, 78 are similar to those used conventionally to make an electrical connection on a nine volt household battery. Through this construction, by a simple press fit step, the end fitting 62 can be releasably frictionally maintained mechanically connected to the housing 14 and electrically connected to the circuit board 48.

To prevent unauthorized disconnection of the jumper element ends 24, 26 from the housing 14 and circuit board 48, a locking system 86 is employed. The locking system 86 includes cooperating a) locking assembly 88 on the housing 14 and b) locking assemblies 90, 90' on the jumper element ends 24, 26, respectively.

The housing locking assembly 88 consists of a latch assembly 92, which in this case is shown as a single piece locking plate 94. The plate 94 is engaged with an operating end 96 on a keyed tumbler 98 to follow pivoting movement thereof around an axis 100 guidingly within and relative to a casing 102. By inserting an authorized control key 104 in a keyway 106 on the tumbler 98, the locking plate 94 can be moved by pivoting about the axis 100 between a first position shown in FIG. 8 to a second position shown in FIG. 9. In the first position, the locking plate 94 is situated so that it does not block direction of the first and second end fittings 62, 64 through complementarily-shaped top housing openings 108, 108' into releasable mechanical connection with the housing 14 and electrical connection through the connecting parts 78, 78' with the printed circuit board 48.

Figure 6:
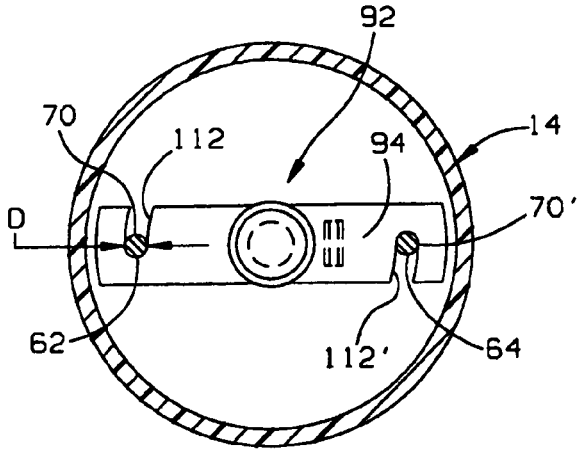
FIG. 6 is an enlarged, cross-sectional view of the monitoring system taken along line 6—6 of FIG. 5 and showing a locking system with cooperating locking assemblies on the housing and jumper element.
Figure 7:
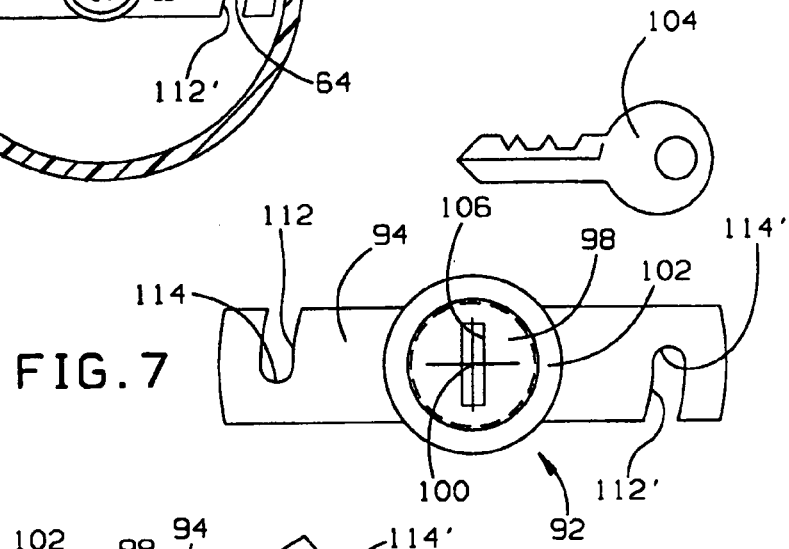
FIG. 7 is an enlarged, plan view of the locking assembly on the housing and with an operating key therefor.
Figure 8:
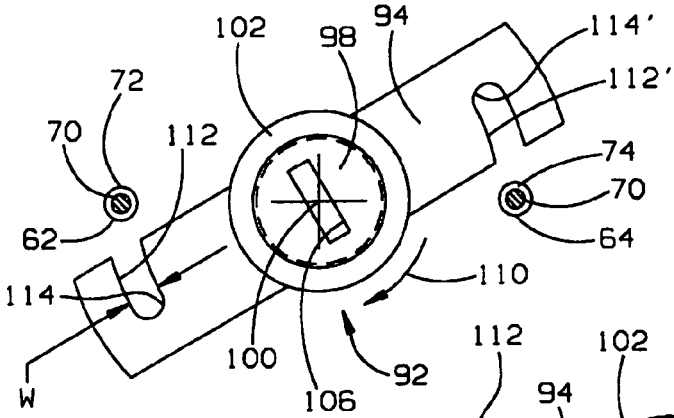
FIG. 8 is a view as in FIG. 7 and showing the locking assembly on the housing in one position relative to the locking assemblies on the jumper element, with the locking system in a released state.
Figure 9:
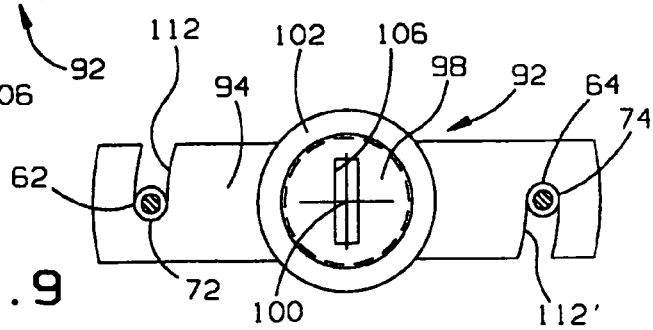
FIG. 9 is a view as in FIG. 8 with the locking system in a locked state.

By then pivoting the locking plate 94 through the key 104 around the axis 100 in the direction of the arrow 110 in FIG. 8, the reduced diameter midportions 70, 70' of the bodies 66, 66' are caused to move, one each, into slots/receptacles 112, 112' at diametrically opposite locations on the locking plate 94. The slots 112, 112' open oppositely and each have a width dimension W (FIG. 8) that is slightly greater than the diameter D (FIG. 6) of the reduced diameter midportions 70, 70' of the bodies 66, 66'. Thus, the midportions 70, 70' move into the slots 112, 112' up to base edges 114, 114' at the ends thereof. This represents the locked state for the locking system 86, as shown in FIGS. 6 and 9, with the released state therefor shown in FIG. 8.

With the locking system 86 in the locked state, spaced shoulders 116, 116', on the locking plate 94 and closely surrounding the slots/receptacles 112, 112', respectively, confront the shoulders 72, 72' to prohibit both electrical and mechanical disconnection of the jumper element ends 24, 26 from the housing 14 and circuit board 48.

Figure 2:
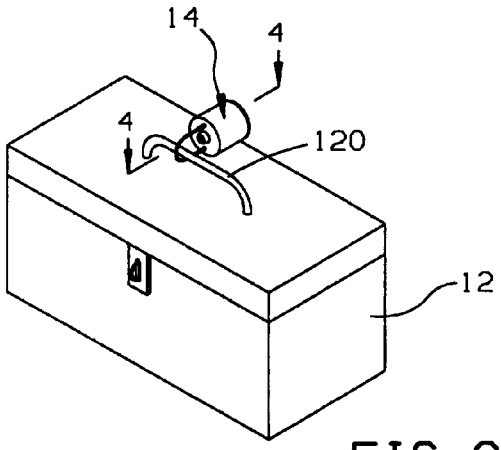
FIG. 2 is a perspective view of an article, in the form of a portable tool box, having a handle to which the inventive monitoring system is operatively connected.
Figure 3:
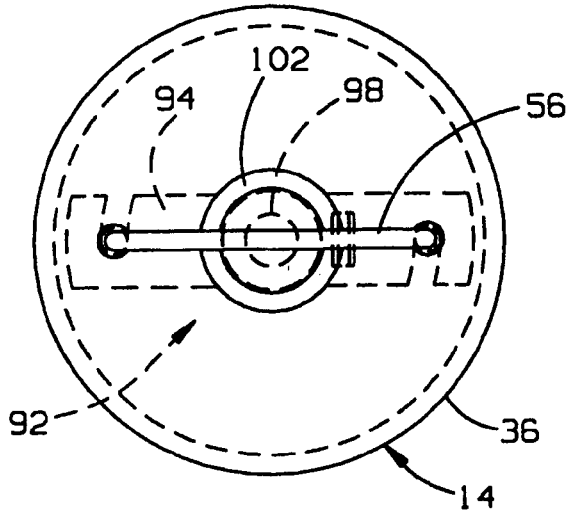
FIG. 3 is an enlarged, plan view of the inventive monitoring system in FIG. 2.

Consequently, with a closed loop 118, defined cooperatively by the jumper element 20 and the housing 14, surrounding a handle 120 on an exemplary article 12 shown in FIG. 2 in the form of a tool box, the only way for a thief to separate the system 20 from the article 12, without reconfiguring the article 12, would be to sever the jumper element 20. This causes an interruption of the conductive path between the first and second locations 52, 54 on the circuit board 48. This will cause the detectable signal generator 22 to generate a signal that alerts a system supervisor of a breach.

In one embodiment, it is preferred that the detection circuit 16 have separate armed and unarmed states. In the unarmed state, the jumper element 20 can be installed and fully separated from the remainder of the system 20. Once the jumper element 20 is placed in the operative state, the locking system 86 can be placed in its locked state. The detection circuit 16 can in turn be placed in the armed state.

It suffices to say that the detection circuit 16 is changed from the unarmed state into the armed state by actuating the switch 50. As seen most clearly in FIGS. 11 and 12, the switch 50 has an actuating element 26 that is spring biased to a normal state, as shown in solid lines in FIGS. 11 and 12. As the locking plate 94 is moved from the FIG. 8 position into the FIG. 9 position, to thereby place the locking system 86 in the locked state, a corner 128 on the locking plate 94 engages an inclined edge 130 on the actuating element 126, thereby camming/pivoting the actuating element 126 around an axis 132 from the normal position to an activated position, as shown in doffed lines in FIG. 11. As this occurs, the detection circuit 16 is changed from the unarmed state into the armed state. Consequently, through operation of the keyed tumbler 98, by a simple pivoting movement of the locking plate 94, the locking system 86 can be placed in its locked state simultaneously as the detection circuit 16 is caused to be changed from the unarmed state to the armed state therefor. One or more LED's 134 (one shown in FIG. 5) may be provided to give a visual indication as to the state of the detection circuit 16 and also to be energized in the event of a breach.

With the detection circuit 16 in the armed sate and the jumper element 20 in the operative state and either a) one or both of the jumper element ends 24, 26 disconnected or b) the jumper element 20 severed, the detectable signal generator 22 is activated. The signal generator 22 preferably is one that produces an audible sound. However, generation of any other type of detectable signal is contemplated, such as a visible signal, etc., either at an on-site or a remote location.

By reason of being able to fully separate the jumper element 20 from the housing 14, the system 10 lends itself to being reconstructed by substituting a new jumper element in the event that the first jumper element 20 is destroyed, as by severance thereof. Additionally, the system 10 can be sold in kit form including a single, universal, housing 14 with multiple jumper elements, potentially having different configurations. For example, as shown in FIG. 13, one of the jumper elements 20 has a first length with a separate jumper element 20' having a shorter overall length. The jumper elements 20, 20' are interchangeably connectable to the housing 14.

As shown, in FIG. 14, the kit could include jumper elements 20", 20'" having a different diameter for different applications.

As a still further variation, one of the jumper elements may be rigid in shape, with the other flexible in nature.

Figure 4:
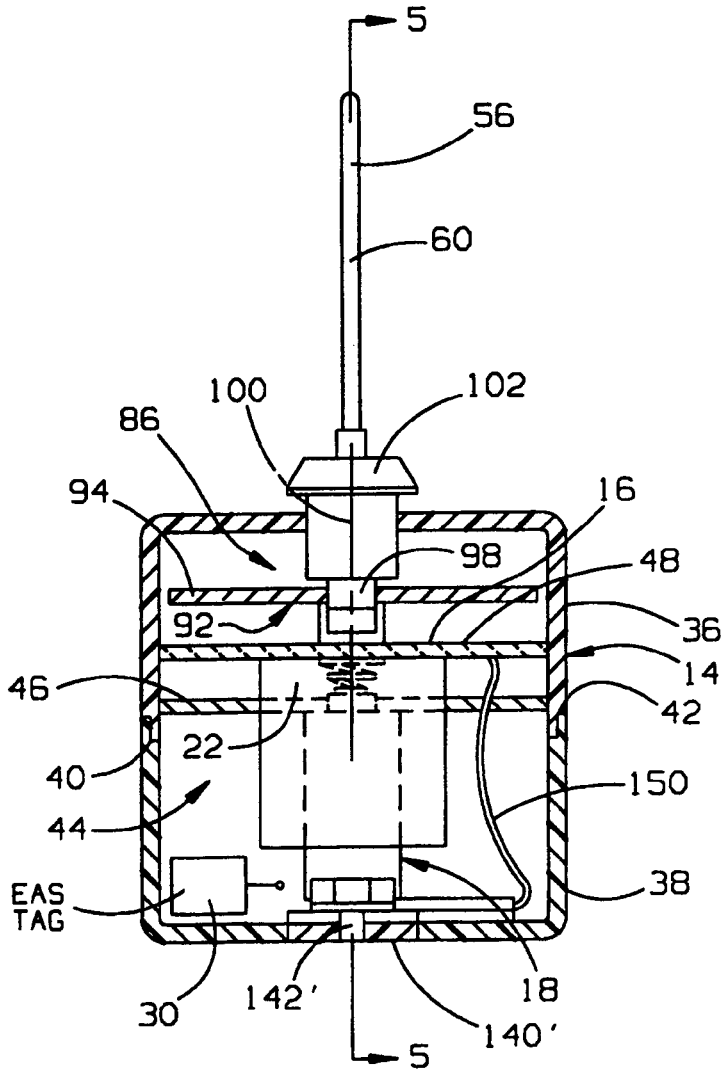
FIG. 4 is an enlarged, cross-sectional view of the monitoring system taken along line 4—4 of FIG. 2.
Figure 5:
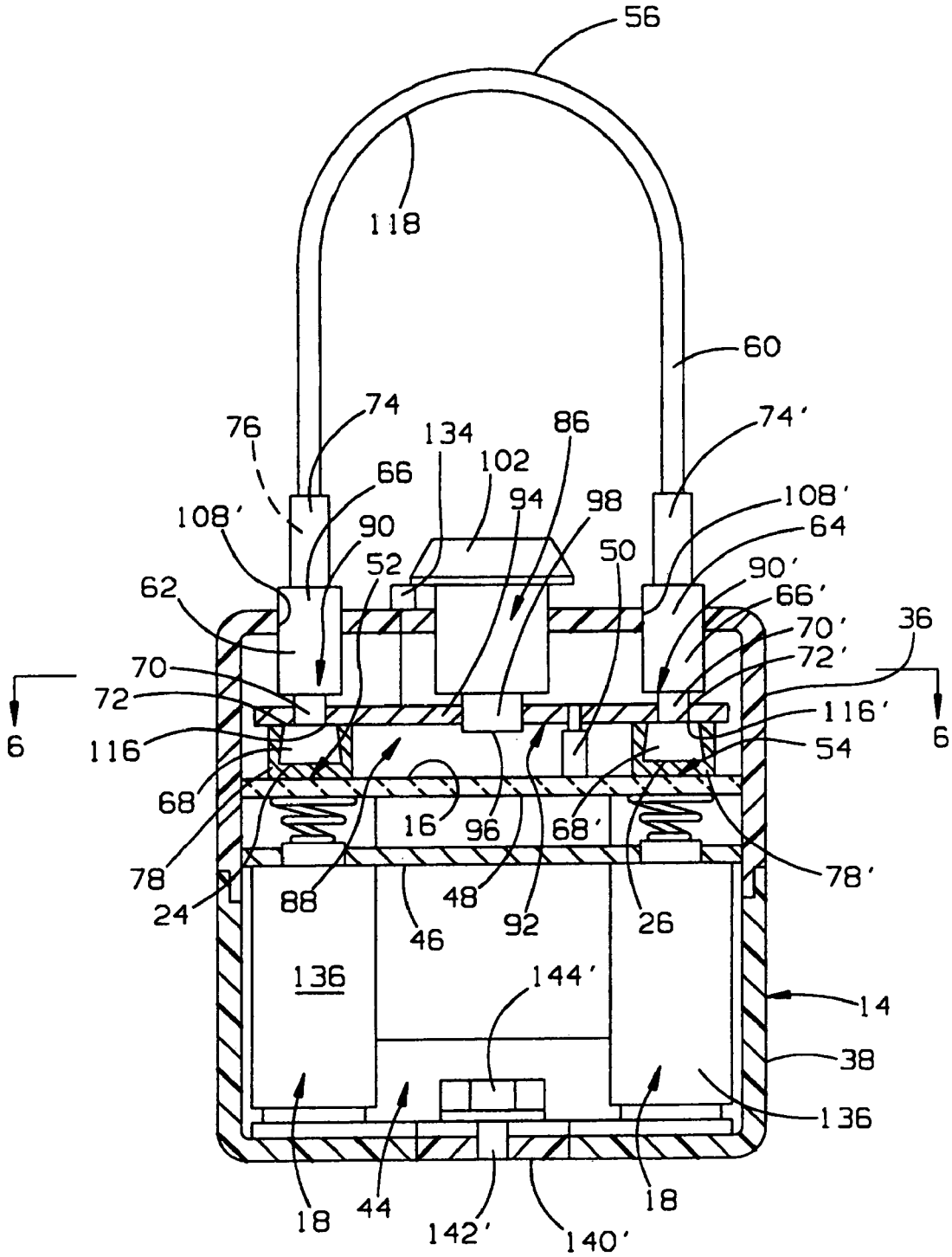
FIG. 5 is an enlarged, cross-sectional view of the monitoring system taken along line 5—5 of FIG. 4.
Figure 15:
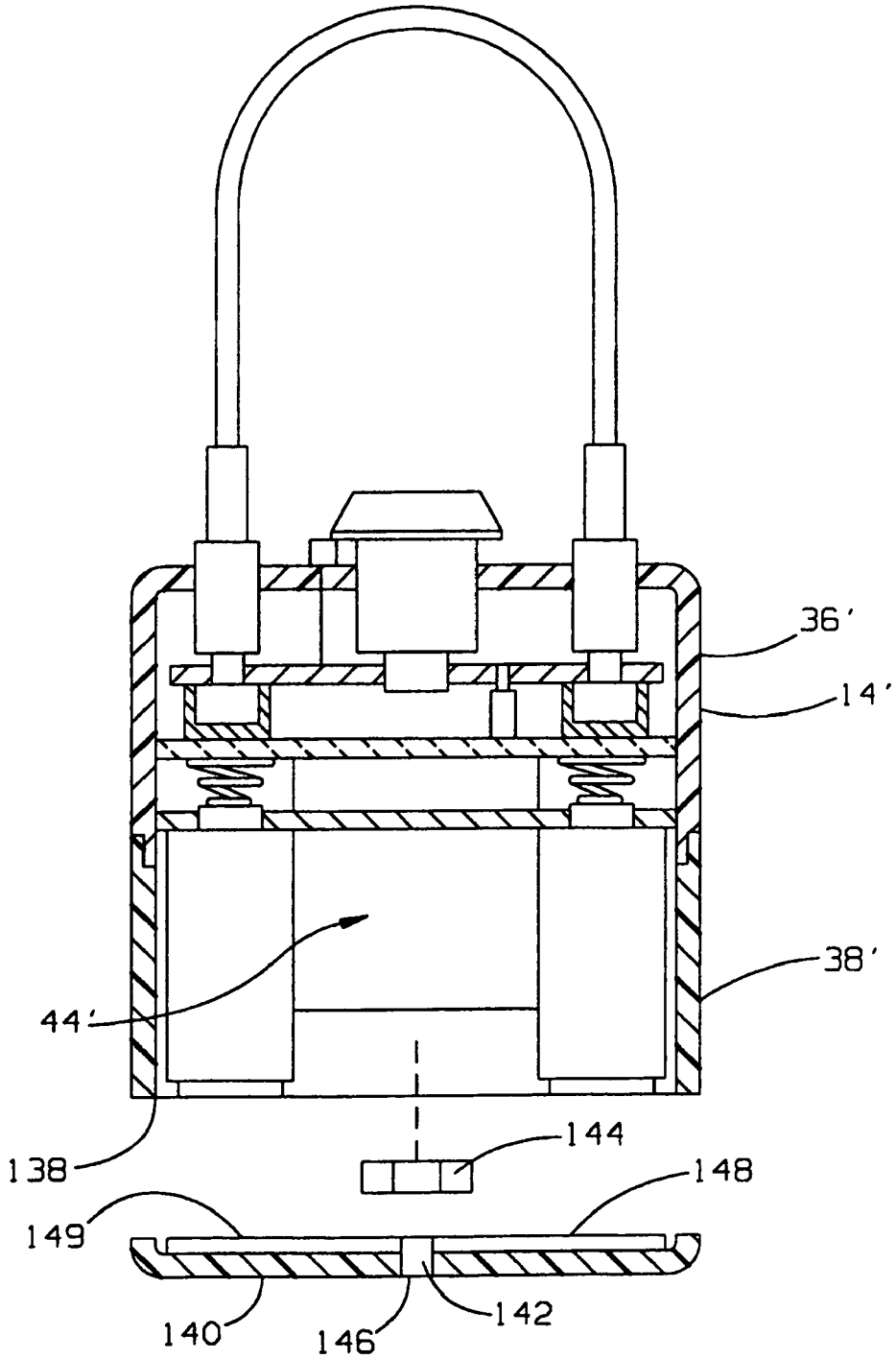
FIG. 15 is a view of a modified form of monitoring system, according to the present invention, corresponding to that in FIG. 5, but including a separable access component/cover 140.

The detection circuit 16 and detectable signal generator 22 are powered by the supply 18, which is preferably self-contained within the housing 14. As shown, the power supply 18 has a pair of permanently installed, or replaceable, batteries 136. To facilitate installation and replacement of the batteries 136, a modified form of housing 14', shown in FIG. 15, can be utilized. The housing 14' has separate housing halves 36', 38', with the housing half 38' having a bottom opening 138 which facilitates access to the chamber 44'. A repositionable housing component/cover 140 is secured to the remainder of the housing 14' through a security element 142 which is threaded into a nut 144. The nut 144 is suitably fixed at the inside of the chamber 44'. The security element 142 is threaded into the nut 144 and has a tamperproof head 146, of conventional construction, which requires a special tool (not shown) to effect turning thereof for purposes of assembling and disassembling the cover 140. With the cover 140 separated from the remainder of the housing 14', the components internally of the chamber 44', including the batteries 136, can be accessed for inspection and/or maintenance. A mounting wall 148 on the cover 140 has a conductive surface 149 to electrically engage poles on the batteries 136. The mounting wall 148 is electrically connected to the circuit board 48 through appropriate wiring 150, as shown in FIG. 4.

An optional, access door 140', corresponding to the housing component/cover 140, can be used on the housing for selective access to the chamber 44. A security element 142' cooperates with a nut 144'.

As noted above, the details of the exemplary system 10 described herein are intended to be exemplary only. The invention is, however, directed to the more generic concepts depicted in FIG. 1.

The materials of construction are likewise for the most part design considerations. For example, the housing 14 may be made from plastic, metal, or other suitable material(s) known to those skilled in this art.

Figure 16:
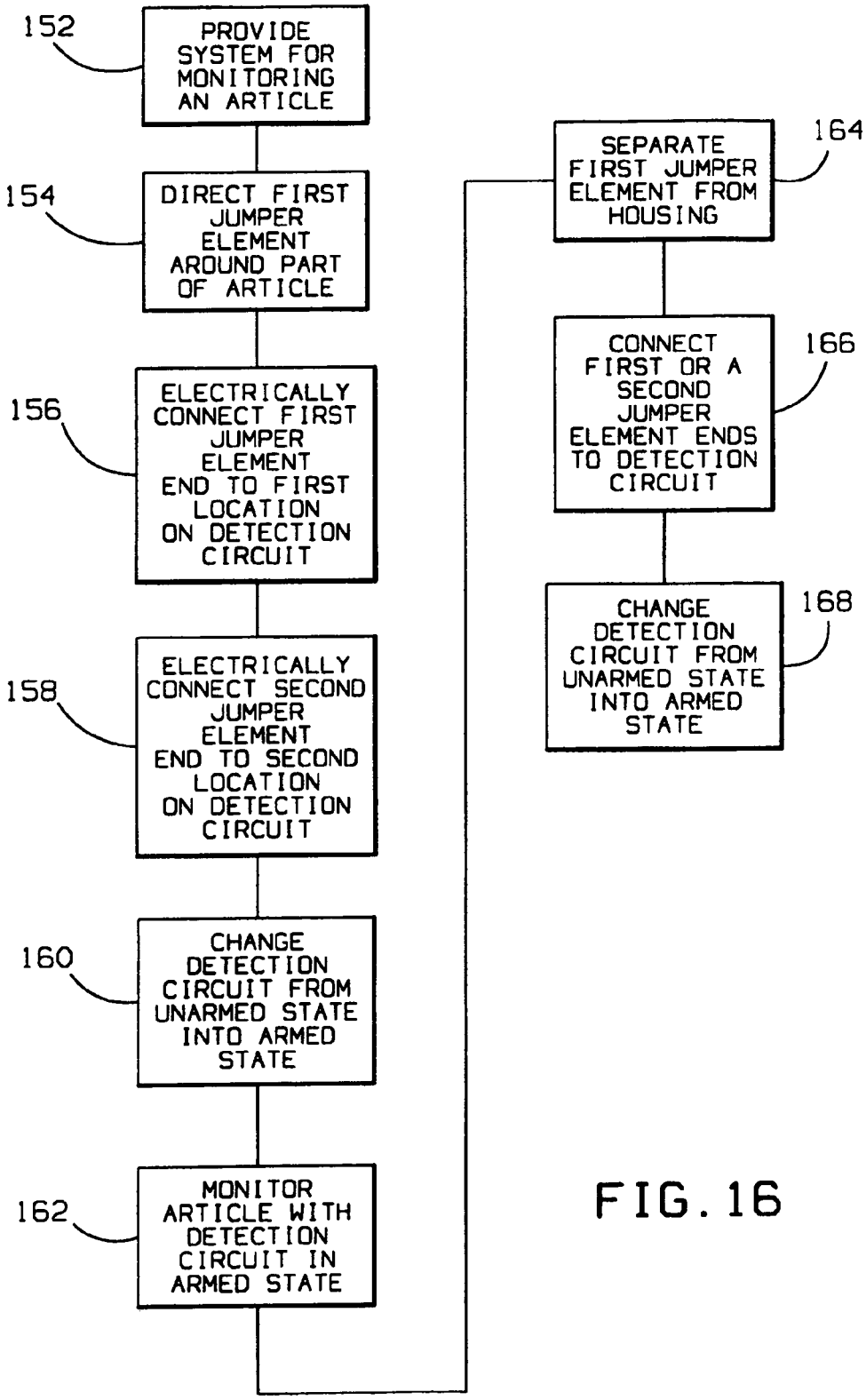
FIG. 16 is a flow diagram representation of one method of monitoring a portable object, according to the present invention.

With the structure described above, the portable articles 12 can be monitored as follows, as depicted in flow diagram form in FIG. 16. As shown at block 152, a system is provided for monitoring an article, which system includes a housing, a detectable signal generator on the housing, a detection circuit on the housing having an armed state and an unarmed state, and a first jumper element having first and second ends. As shown at block 154, the first jumper element is directed around a part of the portable article. As shown at block 156, the first end of the first jumper element is electrically connected to the detection circuit at a first location. As shown at block 158, the second end of the first jumper element is electrically connected to the detection circuit at a second location, so that a conductive path is defined by the first jumper element between the first and second locations. The detection circuit is then changed from the unarmed state into the armed state, as shown at block 160. The article is monitored with the detection circuit maintained in the armed state, as shown at block 162. If the system 10 is breached, the jumper element 20 may be severed, or otherwise destroyed. Alternatively, at a checkout counter, the jumper element may be removed from the housing to allow the system to be separated from the article 12, whereupon the article 12, with which the system 10 is associated, can be removed from the premises. In either situation, one or both of the ends of first jumper element may be separated from the housing, as shown at block 164. The ends of the first, or a second, jumper element may be re-connected to the detection circuit, as shown at block 166, with the detection circuit in the unarmed state. As shown at block 168, the detection circuit may then be changed from the unarmed state into the armed state.

As noted above, the system 10 can be used to tether an article 12 relative to a support 28. Alternatively, the system 10 can be used to be transportable with the article 12. In the latter case, the EAS tag 30 will be detectable by the scanner 32 in the event that a would-be thief attempts to exit from a prescribed area with the article 12 with the system 10 thereon. It should be understood that the term "EAS tag" 30 as used herein, is intended to encompass any type of element or assembly that would be detectable by a scanner to produce a signal, that either directly or indirectly causes the production of a detectable signal to alert a supervisor of the premises that there has been a breach. While not required, it is preferred that the EAS tag 30 be permanently maintained in a state wherein it can be detected by the scanner 32. Consequently, the only way to circumvent the scanner 32 is to remove the system 10 from the article 12. This can be accomplished by inserting the control key 104 and, by manipulating the control key 104 thereby changing the state of the locking system 86 and detection circuit 16, and thereafter separating the ends of the jumper element 20 from the housing 14, and disconnecting the jumper element ends from the printed circuit board 48.

The foregoing disclosure of specific embodiments is intended to be illustrative of the broad concepts comprehended by the invention.

The invention claimed is:

1. A system for monitoring a portable article, the system comprising:

a housing;

a detectable signal generator on the housing;

a detection circuit on the housing;

a jumper element having first and second ends, the jumper element having a) an operative state wherein the first and second jumper element ends are electrically connected to the detection circuit at first and second locations and the jumper element defines a conductive path electrically connecting between the first and second locations on the detection circuit and b) a disabled state wherein one of i) the first end of the jumper element is disconnected from the detection circuit at the first location, ii) the second end of the jumper element is disconnected from the detection circuit at the second location, and iii) the jumper element is severed between the first and second ends so that the conductive path between the first and second locations is interrupted, the first and second ends of the jumper element releasably connectable to the detection circuit to allow the jumper element to be selectively removed and either reinstalled or replaced by another jumper element; and a locking system comprising cooperating locking assemblies on the first and second jumper element ends and the housing, wherein the locking assembly on the first jumper element end comprises a first shoulder and the locking assembly on the housing comprises a second shoulder, the first and second shoulders confronting each other to prevent the first end of the jumper element from being disconnected from the detection circuit at the first location, wherein the locking assembly on the housing has a locked state and a released state, with the locking assembly on the housing in the released state the first end of the jumper element can be selectively connected to and disconnected from the detection circuit at the first location, and with the first end of the jumper element connected to the detection circuit at the first location and the locking assembly on the housing in the locked state, the first and second shoulders confront each other to prevent the first end of the jumper element from being disconnected from the detection circuit at the first location, wherein the locking assembly on the second jumper element end comprises a third shoulder and the locking assembly on the housing comprises a fourth shoulder, with the locking assembly on the housing in the released state the second end of the jumper element can be selectively connected to and disconnected from the detection circuit at the second location, and with the second end of the jumper element connected to the detection circuit at the second location and the locking assembly on the housing in the locked state, the third and fourth shoulders confront each other to prevent the second end of the jumper element from being disconnected from the detection circuit at the second location, wherein the locking assembly on the housing comprises a latch assembly that moves as one piece between a first position wherein the locking assembly on the housing is in the locked state and a second position wherein the locking assembly on the housing is in the released state.

2. The system for monitoring a portable article according to claim 1 wherein the system further comprises an EAS tag on the housing that is detectable by a scanner to determine that the system has moved past the scanner.

3. The system for monitoring a portable article according to claim 2 in combination with a scanner for detecting the presence of the EAS tag and, as an incident thereof, causing the generation of a detectable signal.

4. The system for monitoring a portable article according to claim 3 wherein the EAS tag is permanently in a state to be detected by the scanner and cause the scanner to generate a detectable signal.

5. The system for monitoring a portable article according to claim 1 wherein the latch assembly is pivotable about an axis between the first and second positions.

6. The system for monitoring a portable article according to claim 5 wherein the locking assembly on the housing comprises a key operated tumbler that is repositionable through a key to change the latch assembly on the housing between the first and second positions.

7. The system for monitoring a portable article according to claim 5 wherein the latch assembly on the housing comprises a plate with first and second receptacles to respectively receive portions of the first and second ends of the jumper element.

8. The system for monitoring a portable article according to claim 1 wherein the detection circuit has an armed state and an unarmed state, the system further comprises a switch that is repositionable between normal and activated positions, the detection circuit is changeable from the unarmed state into the armed state as an incident of the switch being changed from the normal position into the activated position, and the switch is changed from the normal position into the activated position as an incident of the latch assembly changing from the second position into the first position.

9. The system for monitoring a portable article according to claim 8 wherein the switch is normally spring biased into the normal position and is engaged by the latch assembly one piece and moved into the activated position as the latch assembly is changed from the second position into the first position.

10. The system for monitoring a portable article according to claim 1 wherein there are cooperating connecting parts on the first end of the jumper element and the housing which releasably, frictionally maintain the first end of the jumper element connected to the detection circuit at the first location.

11. The system for monitoring a portable article according to claim 10 wherein there are cooperating connecting parts on the second end of the jumper element and the housing which releasably frictionally maintain the second end of the jumper element connected to the detection circuit at the second location.

12. The system for monitoring a portable article according to claim 1 wherein the detection circuit has an armed state and an unarmed state and the detectable signal generator is activated as an incident of the jumper element being changed from the operative state into the disabled state with the detection circuit in the armed state.

13. The system for monitoring a portable article according to claim 1 further in combination with a second jumper element that can be placed in an operative state in place of the first claimed jumper element.

14. The system for monitoring a portable article according to claim 13 wherein the second jumper element has a configuration that is different than a configuration of the first claimed jumper element.

15. The system for monitoring a portable article according to claim 14 the first claimed and second jumper elements each have a length and the lengths of the first claimed and second jumper elements are different.

16. The system for monitoring a portable article according to claim 1 wherein the jumper element has a bendable construction.

17. The system for monitoring a portable article according to claim 1 wherein the jumper element has a metal core and first and second end fittings crimped to the metal core and respectively defining the second and third shoulders.

18. The system for monitoring a portable article according to claim 1 wherein the system further comprises a battery power source on the housing for powering the detectable signal generator and the detection circuit.

19. The system for monitoring a portable article according to claim 18 wherein the housing has a component that can be repositioned to selectively allow access to the battery power source, as to permit replacement thereof.

20. The system for monitoring a portable article according to claim 1 in combination with a portable article having a portion around which a closed loop, defines cooperatively by the jumper element and housing, extends.

21. A method of monitoring a portable article, the method comprising the steps of:

a) providing a system for monitoring a portable article, the system comprising:

a housing;

a detectable signal generator on the housing;

a detection circuit on the housing having an armed state and an unarmed state;

a first jumper element having first and second ends; and a locking system having a key-operated tumbler;

b) directing the first jumper element around a part of the portable article;

c) electrically connecting the first end of the first jumper element to the detection circuit at a first location;

d) electrically connecting the second end of the first jumper element to the detection circuit at a second location so that a conductive path is defined by the first jumper element between the first and second locations;

e) with the first and second ends of the first jumper element electrically connected to the detection circuit at the first and second locations, changing the detection circuit from the unarmed state into the armed state, wherein the detectable signal generator will be activated in the event that the conductive path defined by the first jumper element between the first and second locations is interrupted;

f) locking the first jumper element to the housing with the first and second ends of the first jumper element electrically connected to the detection circuit by turning the key-operated tumbler around an axis through a key;

g) disconnecting the jumper element fully from the housing and detection circuit;

h) either i) reconnecting the first and second ends of the first jumper element to the detection circuit at the first and second locations or ii) connecting first and second ends of a second jumper element to the detection circuit at the first and second locations to define a conductive path between the first and second locations; and i) changing the detection circuit from the unarmed state into the armed state with the first and second ends of the first or second jumper element electrically connected to the detection circuit at the first and second locations.

22. The method of monitoring a portable object according to claim 21 wherein the step of providing a system for monitoring an article further comprises the steps of providing an EAS tag on the system and a scanner for detecting the presence of the EAS tag, and as an incident thereof, causing the generation of a detectable signal.

23. The method of monitoring a portable object according to claim 21 wherein the second jumper element has a different configuration than the first jumper element.

24. The method of monitoring a portable object according to claim 23 wherein the first and second jumper elements each has a length and the lengths of the first and second jumper elements are different.

25. The method of monitoring a portable object according to claim 21 wherein the step of locking the first jumper element comprises locking the first and second ends of the first jumper element so that the first and second ends of the first jumper element cannot be disconnected from the detection circuit at the first and second locations.

26. The method of monitoring a portable object according to claim 25 wherein the step of locking the first jumper element comprises repositioning a latch assembly relative to the housing to thereby simultaneously lock the first and second ends of the first jumper element.

27. The method of monitoring a portable object according to claim 26 wherein the detection circuit is changed from the armed state into the unarmed state as an incident of repositioning the latch assembly in a manner so as to lock the first and second ends of the jumper element.

28. The method of monitoring a portable object according to claim 21 wherein the step of electrically connecting the first end of the first jumper element to the detection circuit comprises joining cooperating connecting parts on the first end of the first jumper element and the housing to releasably frictionally maintain the first end of the jumper element connected to the detection circuit at the first location.

29. The method of monitoring a portable object according to claim 21 wherein the step of electrically connecting the second end of the first jumper element to the detection circuit comprises joining cooperating connecting parts on the second end of the first jumper element and the housing to releasably frictionally maintain the second end of the jumper element connected to the detection circuit at the second location.

30. A method of monitoring a portable article, the method comprising the steps of:

a) providing a system for monitoring a portable article, the system comprising:

a housing;

a detectable signal generator on the housing;

a detection circuit on the housing having an armed state and an unarmed state a first jumper element having first and second ends; and a locking system comprising a latch assembly;

b) directing the first jumper element around a part of the portable article;

c) electrically connecting the first end of the first jumper element to the detection circuit at a first location;

d) electrically connecting the second end of the first jumper element to the detection circuit at a second location so that a conductive path is defined by the first jumper element between the first and second locations;

e) with the first and second ends of the first jumper element electrically connected to the detection circuit at the first and second locations, changing the detection circuit from the unarmed state into the armed state, wherein the detectable signal generator will be activated in the event that the conductive path defined by the first jumper element between the first and second locations is interrupted;

f) locking the first and second ends of the first jumper element with the first and second ends of the jumper element electrically connected to the detection circuit by repositioning the latch assembly to thereby simultaneously lock the first and second ends of the first jumper element;

g) disconnecting the jumper element fully from the hosing and detection circuit;

h) either i) reconnecting the first and second ends of the first jumper element to the detection circuit at the first and second locations or ii) connecting first and second ends of a second jumper element to the detection circuit at the first and second locations to define a conductive path between the first and second locations; and i) changing the detection circuit from the unarmed state into the armed state with the first and second ends of the first or second jumper element electrically connected to the detection circuit at the first and second locations.

31. A method of monitoring a portable article, the method comprising the steps of:

a) providing a system for monitoring a portable article, the system comprising:

a housing;

a detectable signal .generator on the housing;

a detection circuit on the housing having an armed state and an unarmed state; and a first jumper element having first and second ends;

b) directing the first jumper element around a part of the portable article;

c) electrically connecting the first end of the first jumper element to the detection circuit at a first location;

d) electrically connecting the second end of the first jumper element to the detection circuit at a second location so that a conductive path is defined by the first jumper element between the first and second locations;

e) with the first and second ends of the first jumper element electrically connected to the detection circuit at the first and second locations, changing the detection circuit from the unarmed state into the armed state, wherein the detectable signal generator will be activated in the event that the conductive path defined by the first jumper element between the first and second locations is interrupted;

f) disconnecting the jumper element fully from the housing and detection circuit;

g) connecting first and second ends of a second jumper element, having a configuration different than the first jumper element, to the detection circuit at the first and second locations to define a conductive path between the first and second locations; and h) changing the detection circuit from the unarmed state into the armed state with the first and second ends of the first or second jumper element electrically connected to the detection circuit at the first and second locations.

32. A system for monitoring a portable article, the system comprising:

a housing;

a detectable signal generator on the housing;

a detection circuit on the housing;

a jumper element having first and second ends, the jumper element having a) an operative state wherein the first and second jumper element ends are electrically connected to the detection circuit at first and second locations and the jumper element defines a conductive path electrically connecting between the first and second locations on the detection circuit and b) a disabled state wherein one of i) the first end of the jumper element is disconnected from the detection circuit at the first location, ii) the second end of the jumper element is disconnected from the detection circuit at the second location, and iii) the jumper element is severed between the first and second ends so that the conductive path between the first and second locations is interrupted, the first and second ends of the jumper element releasably connectable to the detection circuit to allow the jumper element to be selectively removed and either reinstalled or replaced by another jumper element; and a locking system that is operable to selectively a) be placed in a locked state thereby to simultaneously lock the first and second jumper element ends with respect to the housing with the jumper element ends electrically connected to the detection circuit; and b) be changed from the locked state into a state wherein both of the first and second jumper element ends can be separated from the housing.

33. The system for monitoring a portable article according to claim 32 wherein the system further comprises a locking system comprising cooperating locking assemblies on the first and second jumper element ends and the housing.

34. The system for monitoring a portable article according to claim 33 wherein the locking assembly on the first jumper element end comprises a first shoulder and the locking assembly on the housing comprises a second shoulder, the first and second shoulders confronting each other to prevent the first end of the jumper element from being disconnected from the detection circuit at the first location.

35. The system for monitoring a portable article according to claim 34 wherein the locking assembly on the housing has a locked state and a released state, with the locking assembly on the housing in the released state the first end of the jumper element can be selectively connected to and disconnected from the detection circuit at the first location, and with the first end of the jumper element connected to the detection circuit at the first location and the locking assembly on the housing in the locked state, the first and second shoulders confront each other to prevent the first end of the jumper element from being disconnected from the detection circuit at the first location.

36. The system for monitoring a portable article according to claim 35 wherein the locking assembly on the second jumper element end comprises a third shoulders and the locking assembly on the housing comprises a fourth shoulder, with the locking assembly on the housing in the released state the second end of the jumper element can be selectively connected to and disconnected from the detection circuit at the second location, and with the second end of the jumper element connected to the detection circuit at the second location and the locking assembly on the housing in the locked state, the third and fourth shoulders confront each other to prevent the second end of the jumper element from being disconnected from the detection circuit at the second location.

37. The system for monitoring a portable article according to claim 36 wherein the locking assembly on the housing comprises a latch assembly that moves as one piece between a first position wherein the locking assembly on the housing is in the locked state and a second position wherein the locking assembly on the housing is in the released state.

* * * * *